US007360532B1

(12) United States Patent
Reynolds et al.

(10) Patent No.: US 7,360,532 B1
(45) Date of Patent: Apr. 22, 2008

(54) APPARATUS AND METHOD FOR CALIBRATING AN ARCHERY BOW

(76) Inventors: Kenneth R. Reynolds, 37255 SR 124, Middleport, OH (US) 45760; Grant G. Reynolds, 27249 Price Strong Rd., Vinton, OH (US) 45686

( * ) Notice: Subject to any disclaimer, the term of this patent is extended or adjusted under 35 U.S.C. 154(b) by 29 days.

(21) Appl. No.: 11/324,092

(22) Filed: Dec. 30, 2005

(51) Int. Cl.
*F41B 5/14* (2006.01)

(52) U.S. Cl. ..... 124/1; 124/86; 248/121; 248/163.1; 248/176.3

(58) Field of Classification Search ..... 124/1, 124/80, 86; 248/121, 122.1, 163.1, 172, 248/176.1, 176.3
See application file for complete search history.

(56) References Cited

U.S. PATENT DOCUMENTS 1,804,450 A * 5/1931 Allen ..... 124/24.1
3,568,323 A * 3/1971 Lendway ..... 33/265
3,651,578 A * 3/1972 Saunders et al. ..... 33/506
4,596,229 A * 6/1986 Bell ..... 124/24.1
4,974,576 A * 12/1990 Morey et al. ..... 124/91
4,993,397 A * 2/1991 Cryar et al. ..... 124/23.1
5,121,736 A * 6/1992 Hawk ..... 124/86
5,351,407 A * 10/1994 Van Drielen ..... 33/506
5,628,300 A * 5/1997 Wallendorff ..... 124/1
5,630,568 A * 5/1997 Lubrecht ..... 248/217.4
5,954,041 A * 9/1999 Sands ..... 124/1
6,029,643 A * 2/2000 Golfieri ..... 124/1

* cited by examiner

*Primary Examiner*—John A. Ricci
(74) *Attorney, Agent, or Firm*—Ronald J. Koch

(57) ABSTRACT

An apparatus for calibrating an archery bow sight consists of support member 200 that is slidingly attached to Base Member 100, Support Leg Male Couplings 320, 321, 322 are attached to base member 100, base support legs 300, 301, 302, are slidingly attached to Support Leg Male Couplings 320, 321, 322, Support Member Extension 210 is slidingly attached support member 200, Bow Holder Housing 400 is attached to support member extension 210, Bow Holder Housing Extension 401 is attached to bow holder housing 400, bow holder cavity 430, is attached to bow holder housing extension 401.

5 Claims, 9 Drawing Sheets

FIG. 1B
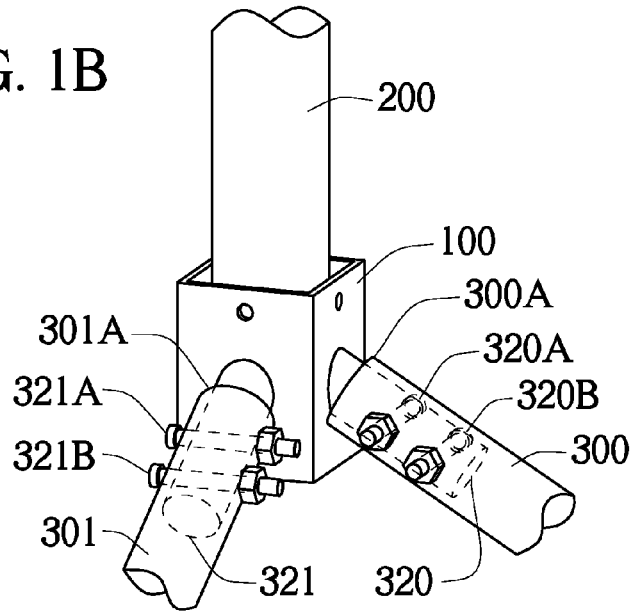
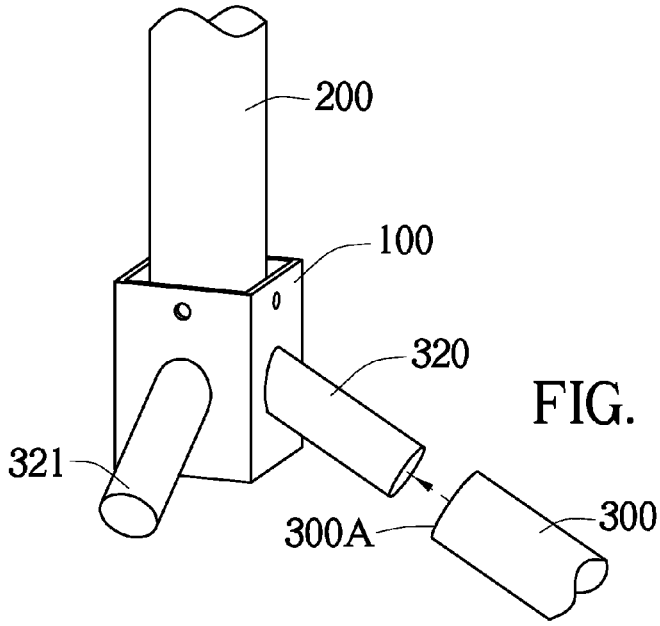
FIG. 1C

FIG. 7
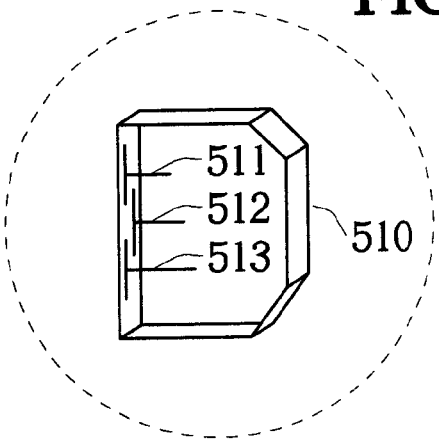
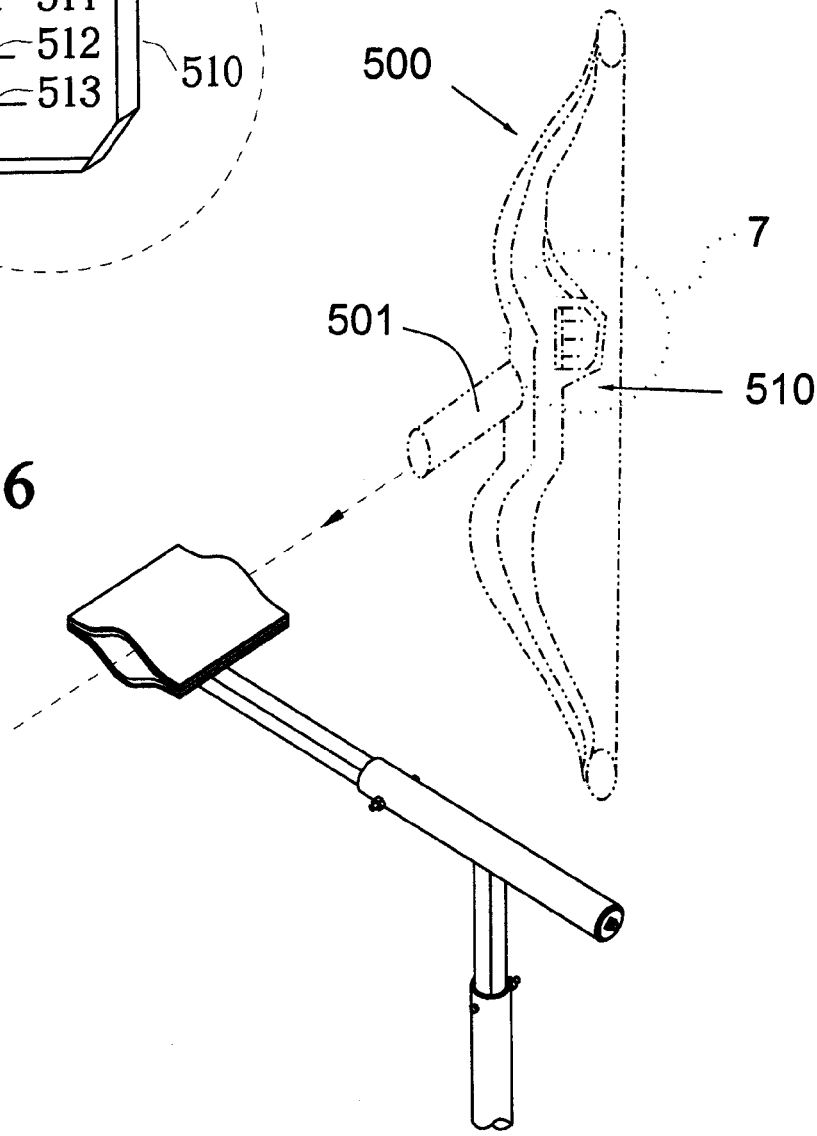
FIG. 6

APPARATUS AND METHOD FOR CALIBRATING AN ARCHERY BOW

BACKGROUND

The present invention relates generally to archery bows and more specifically to archery bows, such as compound bows, having sighting mechanisms. It is known in the art that compound bows incorporate a counter weight typically known as a stabilizer. The stabilizer's purpose is to evenly distribute the weight, or adjust the center of gravity, of the bow. This allows the archer (operator) to more accurately aim and shoot. FIG. 6 depicts an archery bow having a stabilizer 501.

Sighting mechanisms on archery bows are known in the art and are commonly used on archery bows. The purpose of the sighting mechanism is to allow the operator a reference point against which a target may be aligned. Such a typical arrangement includes a sighting mechanism having three "bow sights." FIGS. 6 and 7 show a typical arrangement of an archery bow with a sighting mechanism 510, and three bow sights 511, 512, and 513.

Bow sights are used to aid the operator (archer) in aligning (or calibrating) the reference (sighting) line so that the arrow hits the center of the target. The reference line runs from the archer's eye through the sight pin to the target center. By moving the sight pin, the orientation of the bow is changed consistently with respect to this reference line.

A typical arrangement includes three or more bow sights, each of the sights corresponding to a range of distances. i.e. bow sight one is used for the range of zero to fifty yards, two is used for 50 to 100 yards, and so on.

In the past, the bow sights have been adjusted by the archer manually using an iterative process whereby the archer shoots at the target and then adjusts the bow sights to fine tune the bow. This is problematic because subtle changes (i.e. posture, fatigue) in the archers body as successive shots are fired cause alignment errors in the bow sights. Accordingly, it would be advantageous to have an apparatus that eliminates the human error inherent to conventional sighting calibration techniques. It is an object of this invention to achieve this.

SUMMARY

An apparatus for calibrating an archery bow sight consists of a support member with three legs and an horizontal bow holder onto which a bow holder cavity 430 is attached. The purpose of the bow holder cavity is to receive the stabilizer of an archery bow. The legs can each have leg extensions that allow the length of each leg to be changed. The support member can have an extension that allows the overall height of the invention to be changed. The bow holder housing can have an extension that allows the length to be changed as well as allowing the bow holder cavity 430 to be rotated with respect to the bow holder housing.

In operation, the operator sets up one or more targets in a field or other safe place. Then the base support legs are independently lengthwise adjusted to cause the support member to be substantially vertical. This is especially helpful on uneven terrains. The support member extension is then adjusted to allow the vertical height to be changed and adapted to the operator's physical height. The bow stabilizer is then inserted into the bow holder cavity 430. The cavity is then tightened to secure the bow in place. The bow holder extension is then adjusted to cause the bow sights (and sight line) to approximately line up with the target.

A first test shot is fired and the trajectory compared to the bow sights. Thereafter, successive shots are fired and the bow sights aligned to reflect the trajectory of the arrow. The advantages of the present invention allow the archery bow's position with respect to the targets to be unchanged during this time. The operator may freely move between the archery bow and the targets for inspection, etc without changing the position of the archery bow. In this manner, each bow sight is aligned to correspond to its respective distance range until the sighting mechanism is calibrated.

BRIEF DESCRIPTION OF THE DRAWINGS

FIG. 1B shows a fragmentary, perspective view of a preferred embodiment of the present invention;

FIG. 1C shows a fragmentary, perspective view of a preferred embodiment of the present invention;

FIG. 6 shows a fragmentary, perspective view of a preferred embodiment of the present invention, showing relation of a bow stabilizer and bow holder cavity;

FIG. 7 shows an enlarged view of the archery bow sight mechanism of FIG. 6;

REFERENCE NUMERALS IN DRAWINGS

Figure 1:
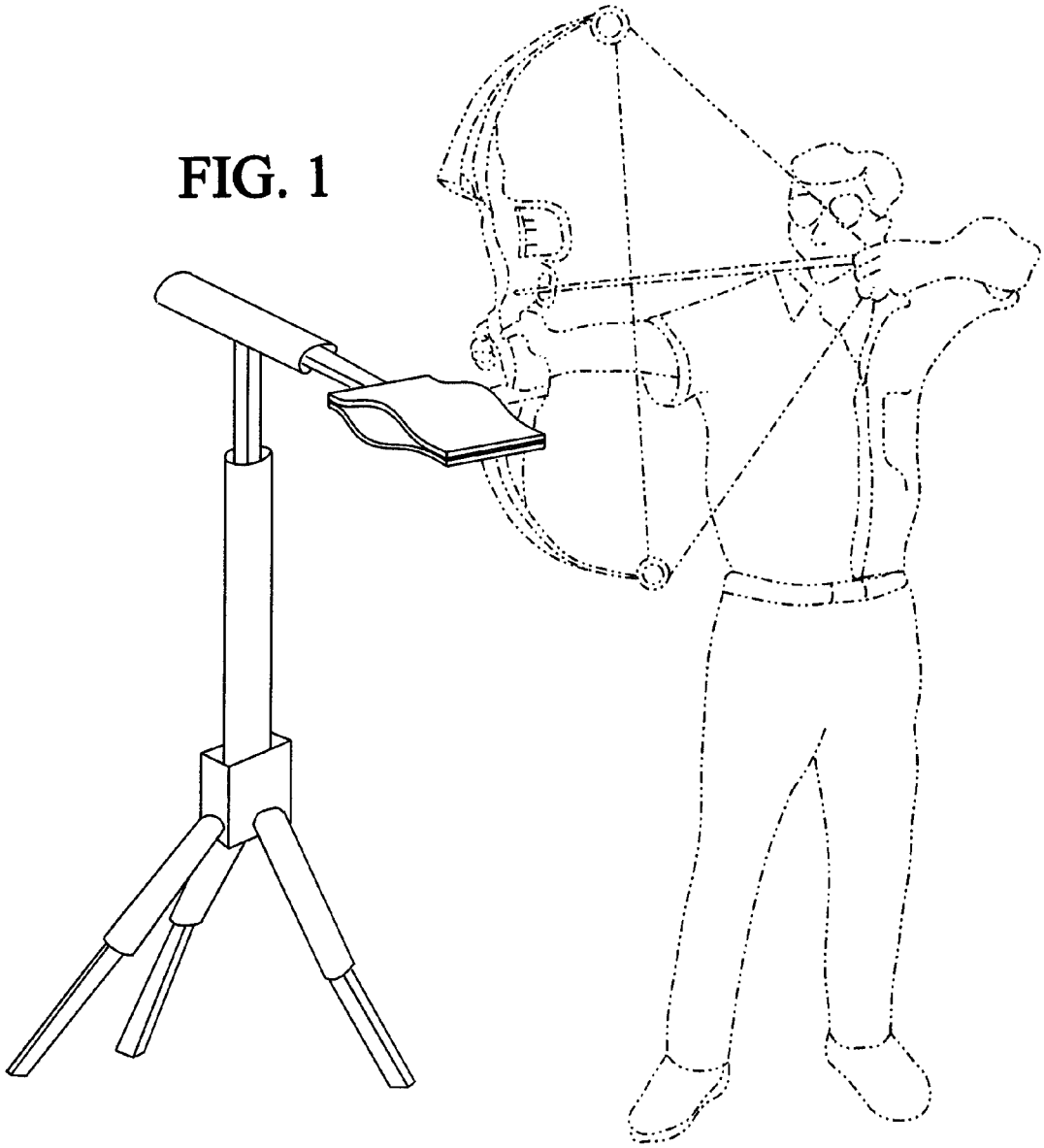
FIG. 1 shows a perspective view of a preferred embodiment of the present invention, in use.

The table below lists the reference numerals employed in the figures, and identifies the element designated by each numeral.

100 Base Member 100
105 First Support Member Fastener 105
107 Second Support Member Fastener 107
200 Support Member 200
201 Support Member Fastener 201
202 first end 202 of Support Member 200
203 second end 203 of Support Member 200
210 Support Member Extension 210
210A first end 210A of Support Member Extension 210
210B second end 210B of Support Member Extension 210
300 First Base Support Leg 300
300A first end 300A of First Base Support Leg 300
300B second end 300B of First Base Support Leg 300
301 Second Base Support Leg 301
301A first end 301A of Second Base Support Leg 301
301B second end 301B of Second Base Support Leg 301
302 Third Base Support Leg 302
302A first end 302A of Third Base Support Leg 302
302B second end 302B of Third Base Support Leg 302
310 First Leg Extension 310

310A first end 310A of First Leg Extension 310
310B second end 310B of First Leg Extension 310
311 Second Leg Extension 311
311A first end 311A of Second Leg Extension 311
311B second end 311B of Second Leg Extension 311
312 Third Leg Extension 312
312A first end 312A of Third Leg Extension 312
312B second end of 312B of Third Leg Extension 312
315 First Leg Fastener 315
316 Second Leg Fastener 316
317 Third Leg Fastener 317
320 First Support Leg Male Coupling 320
320A First Male Coupling Fastener 320A for First Support Leg Male Coupling 320
320B Second Male Coupling Fastener 320B for First Support Leg Male Coupling 320
321 Second Support Leg Male Coupling 321
321A First Male Coupling Fastener 321A for Second Support Leg Male Coupling 321
321B Second Male Coupling Fastener 321B for Second Support Leg Male Coupling 321
322 Third Support Leg Male Coupling 322
322A First Male Coupling Fastener 322A for Third Support Leg Male Coupling 322
322B Second Male Coupling Fastener 322B for Third Support Leg Male Coupling 322
400 Bow Holder Housing 400
400A first end 400A of Bow Holder Housing 400
400B second end 400B of Bow Holder Housing 400
400C middle portion 400C of Bow Holder Housing 400
401 Bow Holder Housing Extension 401
401A first end 401A of Bow Holder Housing Extension 401
401B second end 401B of Bow Holder Housing Extension 401
402 Bow Holder Tightening Bolt 402
404 Holder Extension Fastener 404
410 Upper Bow Holder 410
410A First Bow Holder Fastener 410A
410B Second Bow Holder Fastener 410B
410C Third Bow Holder Fastener 410C
410D Fourth Bow Holder Fastener 410D
411 Lower Bow Holder 411
412 upper surface 412 of Upper Bow Holder 410
414 lower surface 414 of Upper Bow Holder 410
415 Upper Bo Holder Pad 415
416 Lower Bow Holder Pad 416
420 upper surface 420 of Lower Bow Holder 411
421 lower surface 421 of Lower Bow Holder 411
430 Bow Holder Cavity 430
500 Archery Bow 500
501 Archery Bow Stabilizer 501
510 Archery Bow Sight Mechanism 510
511 First Archery Bow Sight 511
512 Second Archery Bow Sight 512
513 Third Archery Bow Sight 513
600 Support Member 600
602 First End 602 of Support Member 600
603 Second End 603 of Support Member 600
700 Support Member 700
702 First End 702 of Support Member 700
703 Second End 703 of Support Member 700
704 Tightening Bolt 704

DETAILED DESCRIPTION

Figure 4:
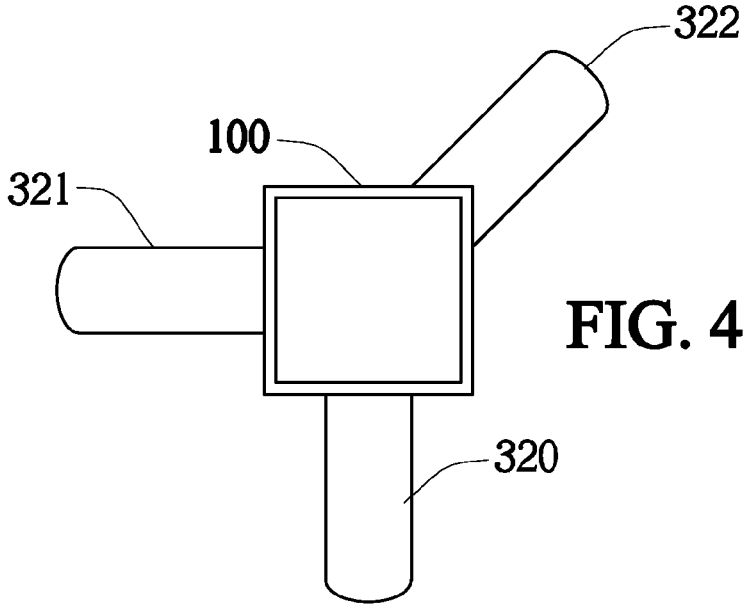
FIG. 4 shows a top view of the base member and support leg male couplings.

As shown in FIGS. 1C and 4, an apparatus for calibrating an archery bow sight has a base member 100, a first support leg male coupling 320 attached to the base member 100, a second support leg male coupling 321 attached to the base member 100, and a third support leg male coupling 322 attached to the base member 100.

In one embodiment, the three support leg male couplings are permanently attached to the base member 100. However, they could be releasably attached by screwing them on or using any other means of removable attachment. Removable attachment is understood to include slidable attachment.

Figure 1A:
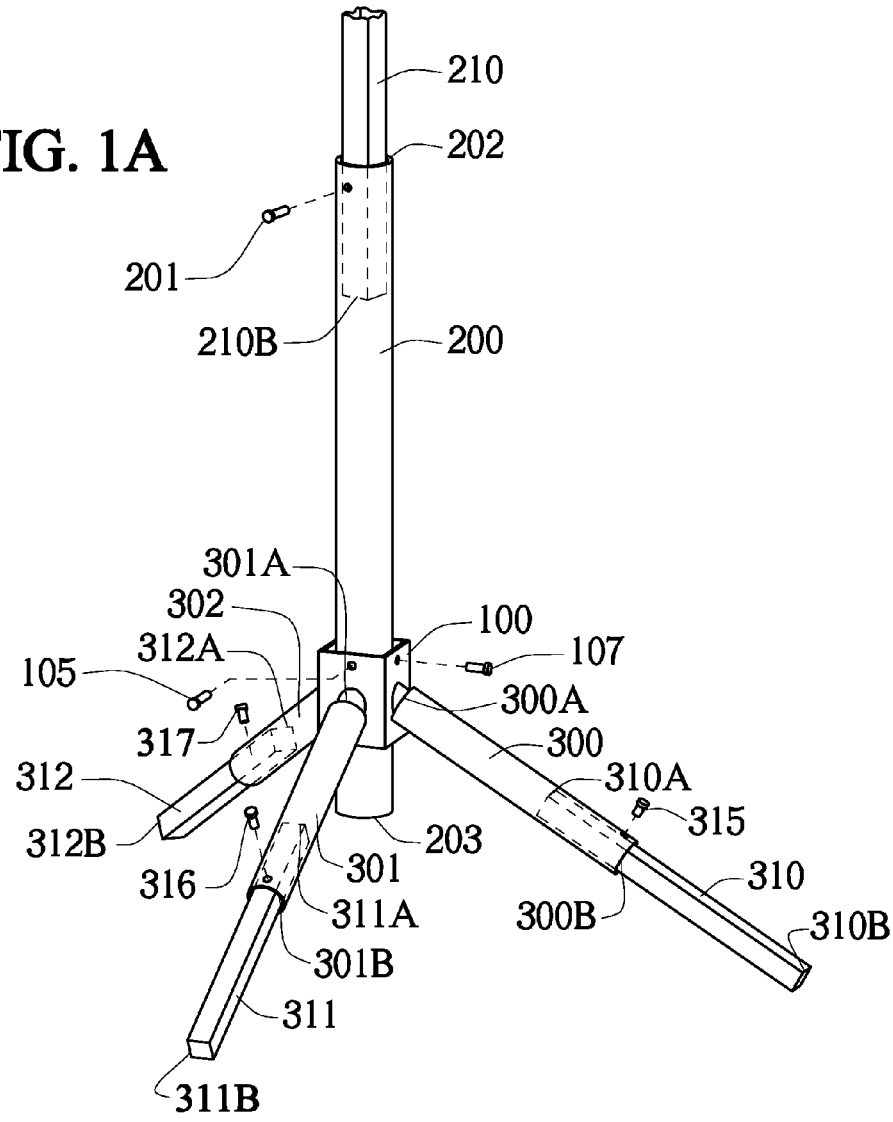
FIG. 1A shows a fragmentary, perspective view of a preferred embodiment of the present invention.

The three base support legs can be either releasably or permanently attached to the respective support leg male couplings. As shown in FIGS. 1A, 1B, and 1C, the three base support legs are each releasably attached to the respective support leg male couplings. This embodiment is preferred because the apparatus may be more easily disassembled for storage and transportation.

As shown in FIGS. 1A and 1C, The first end 300A of first base support leg 300 is releasably attached to the first support leg male coupling 320. Although not shown, the first end 301A of second base support leg 301 is releasably attached to the second support leg male coupling 321. The first end 302A of third base support leg 302 is releasably attached to the third support leg male coupling 322. The support leg male couplings 320, 321, 322 are sufficiently long to allow the respective base support legs 300, 301, 302 to be secured to them. This is depicted in FIG. 1C wherein first base support leg 300 and first support leg male coupling 320 are shown and are representative of the other base support legs and male couplings. The support leg male couplings can be of round or rectangular cross section. Slidable attachment is accomplished by making the base support legs out of a hollow tube having a circular cross section and having an inner diameter large enough to allow the support leg male couplings to fit inside the first ends 300A, 301A, 302A of the respective base support legs 300, 301, 302. Threaded holes are placed coaxially through each pair of support leg male coupling/Support legs and inserting male coupling fasteners through each hole.

Each set of support leg male coupling (320, 321, 322), support leg (300, 301, 302), and support leg extension (310, 311, 312) form the basis of what is effectively a "leg." Therefore, it is apparent that the present invention may have solid legs instead of the multi-part leg assemblies described herein. As will be apparent to those skilled in the art, the support leg male couplings can be eliminated and the base support legs can be permanently attached to the base member. Moreover, the base member can be eliminated and the base support legs can be permanently attached to the support member. This embodiment is not preferred because the invention cannot be disassembled and is therefore not as easily transported. It is understood that permanent attachment includes welding and the like.

In one embodiment (see FIG. 1B), the male coupling fasteners 320A, 320B, 321A, 321B, 322A, and 322B, are threaded bolts thereby allowing them to be tightened for a secure fit. However, other methods may be used. For instance, bolts may be placed all the way through the base support legs and support leg male couplings, then attaching a nut to secure the fit.

FIG. 1B depicts an embodiment where two bolts are used in each pair of support leg male coupling/support legs. First and second male coupling fasteners 320A, 320B connect first support leg male coupling 320 to first base support leg 300. First and second male coupling fasteners 321A, 321B connect second support leg male coupling 321 to first base support leg 301. First and second male coupling fasteners 322A, 322B connect third support leg male coupling 322 to third base support leg 302. Using two bolts or equivalent connectors is preferred because doing so makes the legs stronger and more secure then they would be if only one bolt were used. In another embodiment, only one hole is used.

The three leg extensions 310, 311, 312 can be either releasably or permanently attached to the respective base support legs 300, 301, 302. In one embodiment, the three base support legs are each permanently attached to the respective leg extensions. This can be accomplished by welding or any other suitable method. As will be apparent to those skilled in the art, the leg extensions can be eliminated. This embodiment is not preferred because, as is described herein throughout, the invention will be less effective on uneven terrains. The leg extensions, each being independently adjustable, can be adjusted so as to allow the support member 200 to remain substantially vertical on uneven terrains.

As depicted in FIG. 1A, the first end 310A of first leg extension 310 is slidably attached to the second end 300B of first base support leg 300. The first end 311A of second leg extension 311 is slidably attached to the second end 301B of second base support leg 301. The first end 312A of third leg extension 312 is slidably attached to the second end 302B of third base support leg 302. This is accomplished by making the base support legs out of a hollow tube having a circular cross section and having an inner diameter large enough to allow the first ends of the leg extensions to fit inside the second ends of the base support legs.

As shown in FIG. 1A, first base support leg 300 is secured to first leg extension 310 by first leg fastener 315. Second base support leg 301 is secured to second leg extension 311 by second leg fastener 316. Third base support leg 302 is secured to third leg extension 312 by third leg fastener 317. The leg fasteners are threaded bolts thereby allowing them to be tightened for a secure fit.

The leg fasteners are used to secure the leg extensions to the base support legs by providing a threaded hole through each base support leg and inserting a leg fastener through. The leg extension is then positioned as desired with respect to the base support leg. The leg fastener is then tightened to prevent the leg extension from moving with respect to the base support leg.

In one embodiment (see FIG. 1A), the leg extensions have rectangular cross sections. This is preferred because the rectangular cross section provides a flat surface for the leg fasteners 315, 316, 317 to engage as they are tightened. This provides a secure fit.

In another embodiment, the base support legs and the leg extensions have a circular cross section. This is not preferred because the circular cross section of the leg extension does not provide a flat surface for the leg fasteners to come in contact with. This has the effect of being less stable because the leg extensions can "wobble."

Figure 3:
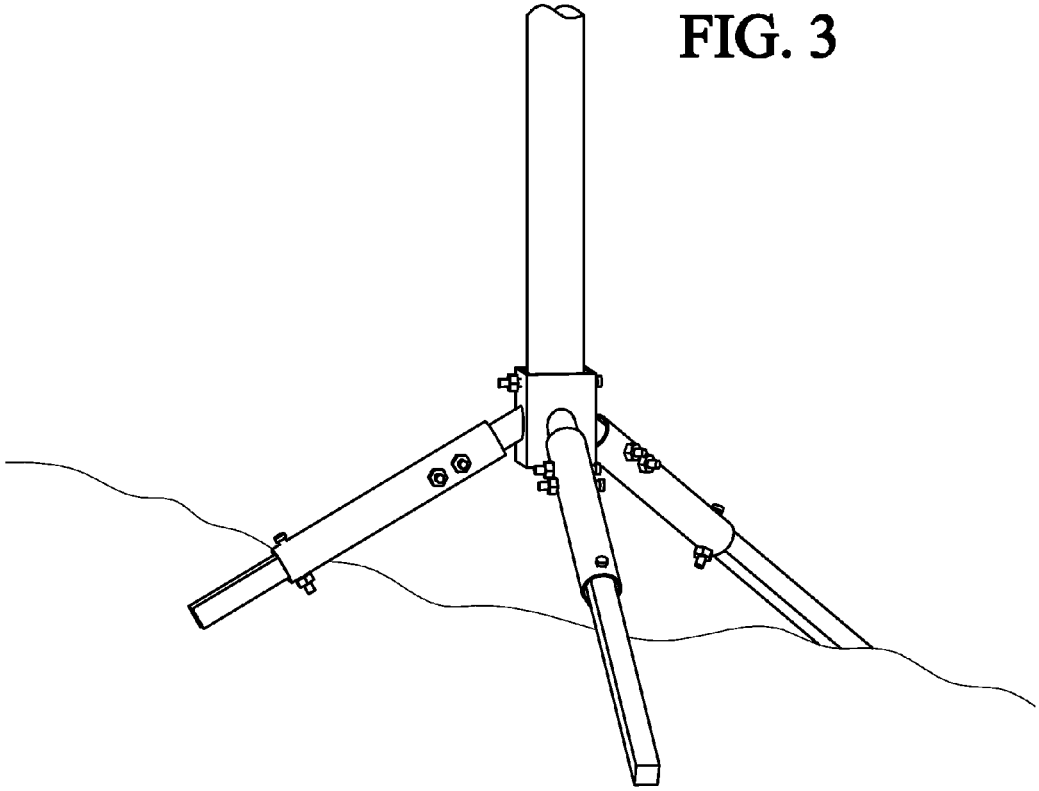
FIG. 3 shows a fragmentary view of a preferred embodiment of the present invention, in use oil a slope.

In one embodiment, the three leg extensions are each slidably attached to the respective base support legs. This embodiment is preferred because the leg extensions allow the apparatus to be used on uneven surfaces. For instance, if on the side of a hill, one of the three legs is simply made sufficiently short so as to allow the support member 200 to be substantially vertical. This embodiment is depicted in FIG. 3. This embodiment is also preferred because the extensions allow a greater range of height adjustment. If all three extensions are extended the same distance, the net effect is to increase the height of the support member 200. The height can also be adjusted by extending support member extension 210 outward away from support member 200.

In one embodiment, depicted in FIG. 4, the first, second, and third support leg male couplings 320, 321, 322 are attached to the base member 100 at substantially equidistant points around the periphery of the base member 100. The equidistant spacing allows for the most efficient weight distribution, balance, and support. However, the spacing around the periphery of base member 100 does not have to be exact. Suitable results can be obtained when the positioning is approximately equidistant.

FIGS. 1A, 1B, 1C, and 4 depict the base member 100 as having a rectangular shape as viewed from above. However, the base member 100 can have any shape suitable for allowing the support member 200 to be inserted into it. For instance, the base member 100 can be circular or ovoidal, or elliptical.

Figure 5:
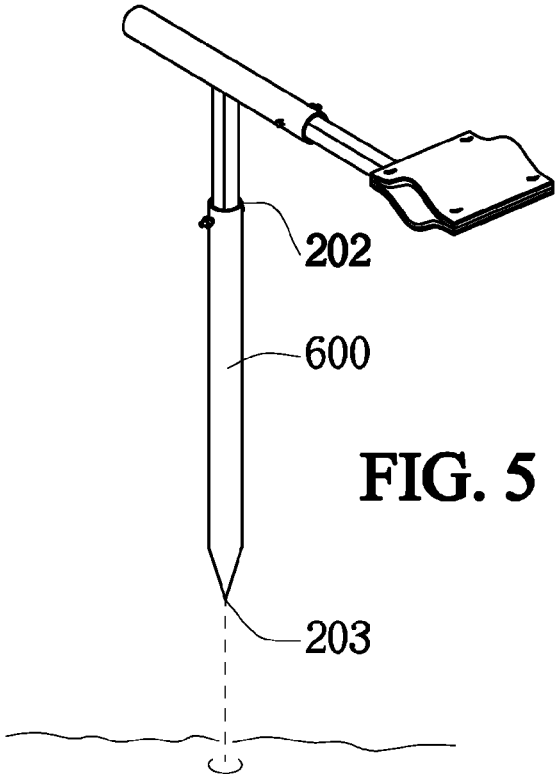
FIG. 5 shows a perspective view of an alternative embodiment of the present invention.

In a preferred embodiment, the apparatus has three legs. However, it could have more than three legs. In fact, it could have many legs or no legs. In one embodiment, depicted in FIG. 5, the apparatus does not have any legs. The second end 603 of support member 600 forms a point whereby the support member 600 can be inserted into a hole in the ground or other surface. This embodiment is not preferred because the unit as a whole is not as stable as one with legs and can loosen in moist ground, etc.

Figure 8:
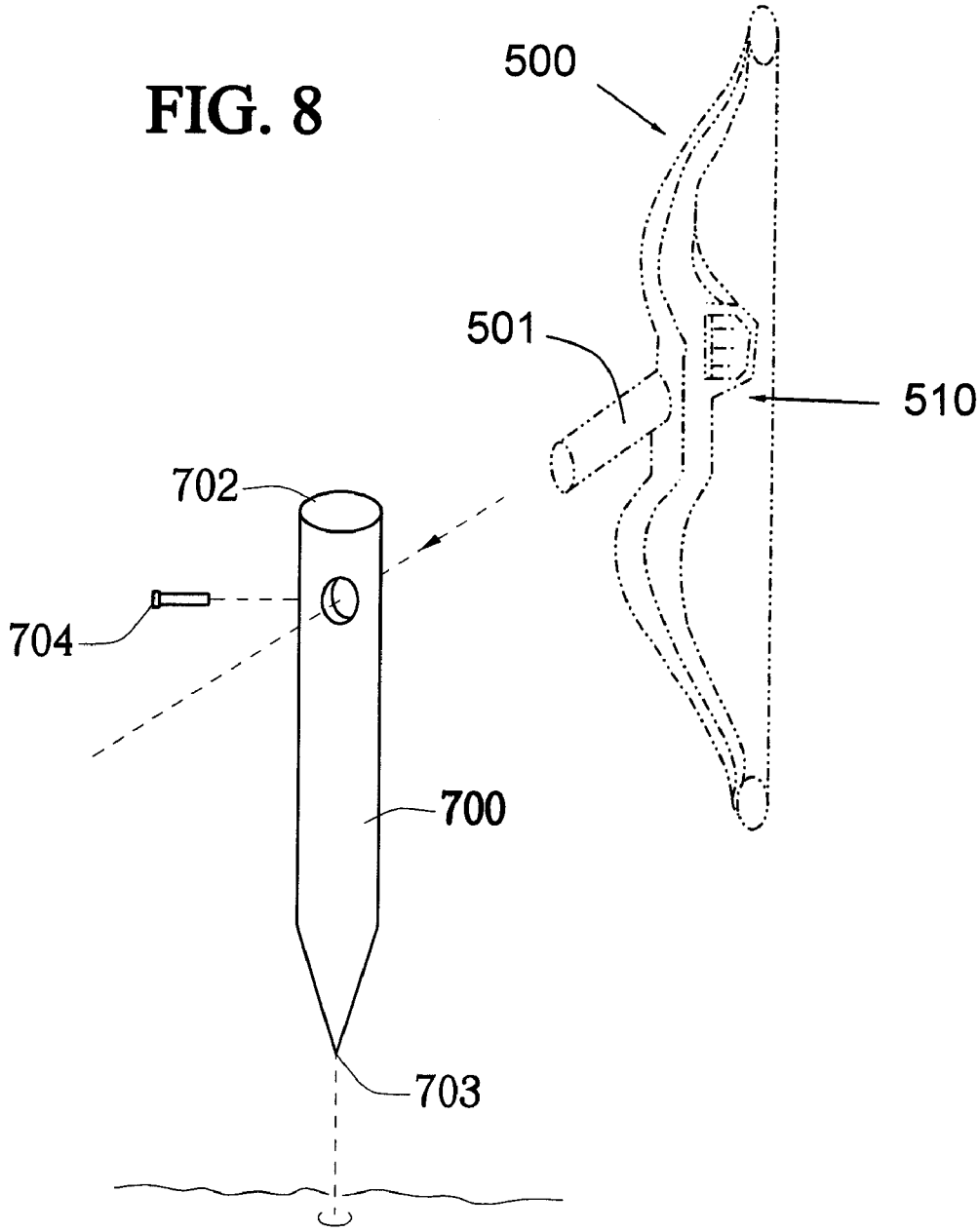
FIG. 8 shows a perspective view of an alternative embodiment of the present invention.

In another embodiment, depicted in FIG. 8, second end 703 of support member 700 forms a point whereby the support member 700 can be inserted into a hold in the ground or other surface. First end 702 of support member 700 has a cavity having a longitudinal axis transverse to the longitudinal axis of support member 700. Bow stabilizer 501 is inserted into the cavity and secured by tightening bolt 704. This embodiment is not preferred because the unit as a whole is not as stable and can loosen in moist ground, etc.

In one embodiment, the legs of the apparatus form an angle of 135 degrees with the support member 200. However, the legs can be at any angle that allows the apparatus to stand relatively upright for its intended purpose. For instance, the legs could form a 90 degree angle with the support member 200. The angle could also be greater than 135 degrees.

The support member 200 can be either releasably or permanently attached to the base member 100. In one embodiment, the support member 200 is permanently attached to the base member 100. This can be accomplished by welding or any other suitable method.

In one embodiment, the support member 200 is releasably attached to the base member 100. This is accomplished by making a threaded hole in base member 100, inserting a threaded bolt into the threaded hole, tightening the bolt thereby extending it inward until it makes contact with the outer surface of support member 200, and continuing to tighten it until support member 200 is secured with respect to base member 100.

In one embodiment, depicted in FIG. 1A, the support member 200 is secured to the base member 100 using two holes in the base member 100. A first support member fastener 105 and second support member fastener 107 are inserted through each of the holes and used to secure the base member 100 to the support member 200. The support member fasteners 105, 107 are threaded bolts.

The support member 200 can be either releasably or permanently attached to the support member extension 210. In one embodiment, the support member 200 is permanently attached to the Support member extension 210. This can be accomplished by welding or any other suitable method.

As depicted in FIG. 1A, first end 202 of support member 200 is slidably attached to the second end 210B of support member extension 210. This is accomplished by making the Support Member 200 out of a hollow tube having a circular cross section and having an inner diameter large enough to allow the support member extension 210 to fit inside.

In one embodiment, the support member extension 210 has a rectangular cross section. This is preferred because the rectangular cross section provides a flat surface for the support member fastener 201 to engage as it is tightened. This provides a secure fit.

In another embodiment, the support member 200 and support member extension 210 have circular cross sections. This is not preferred because the circular cross section of the support member extension 210 does not provide a flat surface for the support member fastener 201 to come in contact with. This has the effect of being less stable because the support member extension 210 can "wobble."

A support member fastener 201, being a threaded bolt, is used to secure the support member 200 to the support member extension 210 by providing a threaded hole through the support member 200 and inserting the support member fastener 201 through. The support member extension 210 is then positioned as desired with respect to the support member 200. The support member fastener 201 is then tightened to prevent the support member extension 210 from moving with respect to the support member 200.

As will be apparent to those skilled in the art, the support member extension can be eliminated altogether and the first end 202 of support member 200 can be attached to the bow holder housing 400. This embodiment is not preferred because the overall vertical height of the invention can not be changed by as great a degree. The support member extension, being adjustable, allows the height to be adjusted. The vertical height can also be adjusted by moving the support member 200 with respect to the base member 100.

Figure 2A:
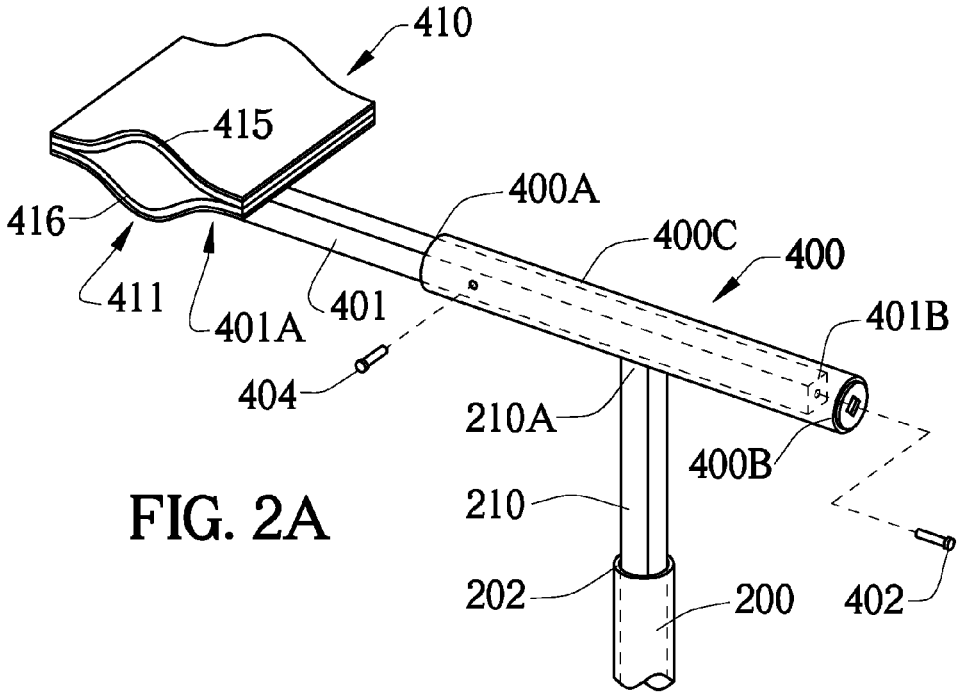
FIG. 2A shows a fragmentary, perspective view of a preferred embodiment of the present invention.

As depicted in FIG. 2A, the bow holder housing 400 has a first end 400A, a middle portion 400C, and a second end 400B. The bow holder housing is hollow within and has a circular cross section. It may also have rectangular or elliptical cross sections. The first end 400A is open, the middle portion 400C is permanently attached to the first end 210A of the support member extension 210. This may be accomplished by welding or any other suitable method.

The bow holder housing extension 401 has a first end 401A and a second end 401B. The second end 401B has a threaded hole and is inserted into the first end 400A of the bow holder housing 400. In a preferred embodiment, the threaded hole is accomplished by welding a threaded nut to the end 401B. It is preferable that the present invention be lightweight. Therefore, aluminum is preferred.

If aluminum is used, and the threaded hole in the second end 401B of the bow holder housing extension 401 is accomplished by welding a nut instead of tapping threads, it is preferable that the nut also be made of aluminum. Not doing so can cause problems welding. Those skilled in the art will appreciate the necessity of not welding dissimilar materials.

As depicted in FIG. 2A, the second end 400B of the bow holder housing 400 has a hole. The purpose of this hole is to allow the bow holder tightening bolt 402 to pass through and engage the second end 401B of the bow holder housing extension 401. As bow holder tightening bolt 402 is tightened, the second end 401B of bow holder housing extension 401 is drawn toward the second end 400B of bow holder housing 400 and thereby secured. Bow holder housing extension 401 is generally rotated with respect to bow holder housing 400 so that the bow holder cavity 430 (explained below) can be horizontal.

As shown in FIG. 2A, bow holder housing 400 has a threaded hole near the first end 400A. The purpose of this hole is to allow the holder extension fastener 404, which is a threaded bolt, to be inserted therein and engage the outer surface of the bow holder housing extension 401. As the holder extension fastener 404 is tightened, it presses firmly against the outer surface of bow holder housing extension 401 thereby securing it.

The purpose of the bow holder tightening bolt 402 and holder extension fastener 404 is to securely fasten the bow holder housing extension 401 with respect to the bow holder housing 400. They can be used in combination or alone so long as the purpose is achieved. Other methods can be used so long as the main purpose is achieved.

Figure 2B:
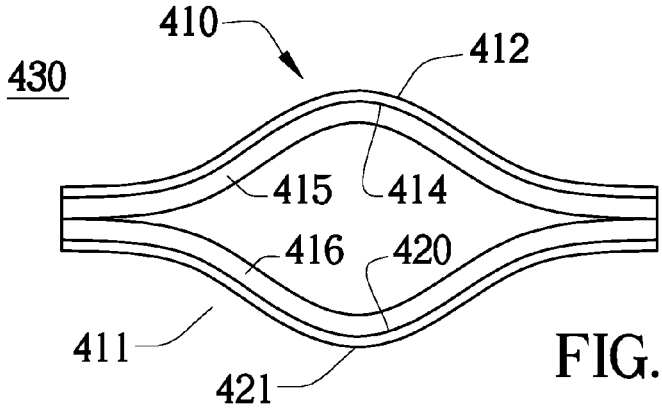
FIG. 2B shows a side view of the bow holder cavity.

A bow holder cavity 430 is formed by releasably attaching upper bow holder 410 to lower bow holder 411. The purpose of the bow holder cavity is to allow insertion of a stabilizer of an archery bow. The stabilizer is inserted and secured in the cavity so that it does not move. FIGS. 2A, 2B, and 2C depict a lower bow holder 411 that has a lower surface 421 and an upper surface 420. A lower bow holder pad 416 is attached to upper surface 420 of lower bow holder 411. The lower bow holder 411 is shaped to form an upwardly facing chapel.

Figure 2D:
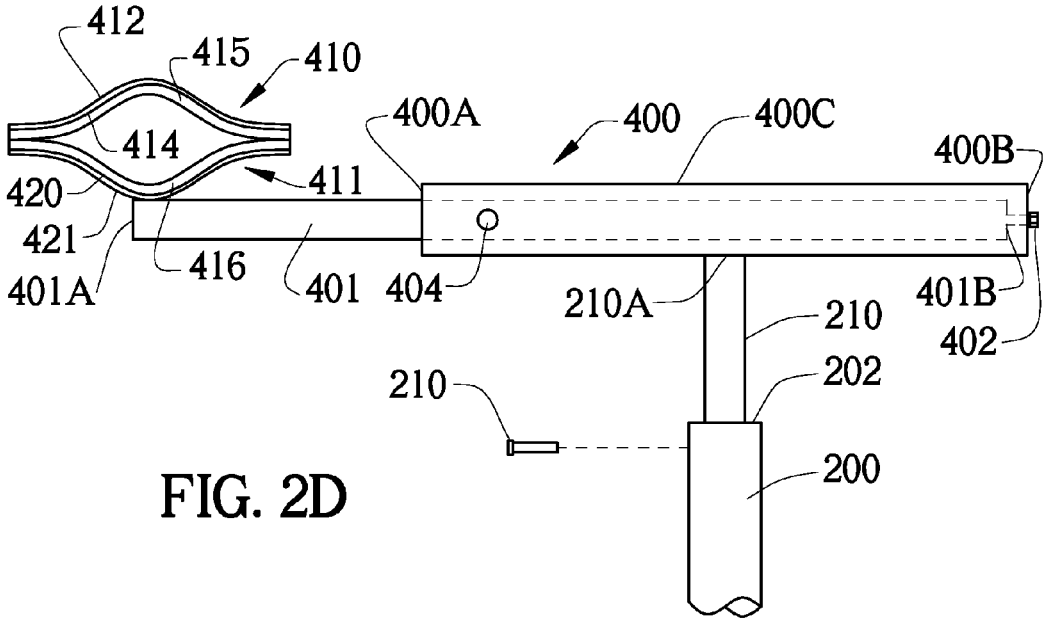
FIG. 2D shows a fragmentary, side view of a preferred embodiment of the present invention.
Figure 2C:
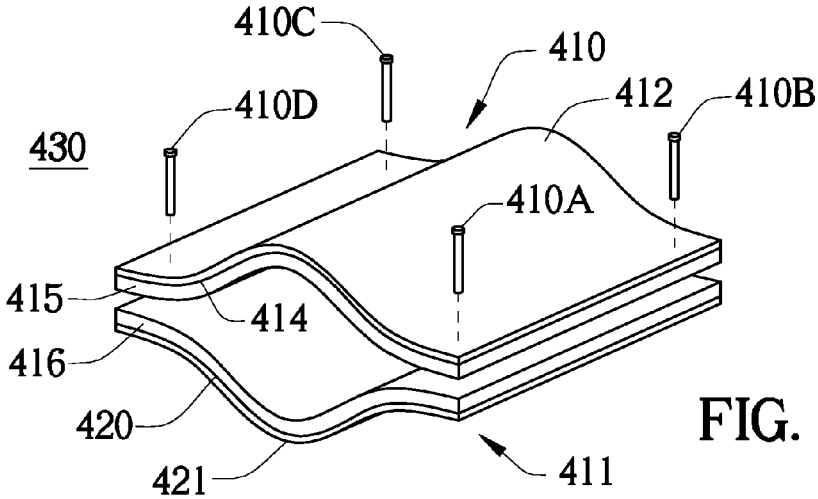
FIG. 2C shows a perspective view of the bow holder cavity.

As depicted in FIG. 2D, the lower surface 421 of lower bow holder 411 is attached to the first end 401A of bow holder housing extension 401. This may be accomplished by either permanent or releasable fastening.

An upper bow holder 410 has a lower surface 414 and an upper surface 412. The upper bow holder pad 415 is attached to lower surface 414 of upper bow holder 410. The upper bow holder 410 is shaped to form an downwardly facing channel.

As depicted in FIG. 2C, the upper bow holder 410 is releasably attached to the lower bow holder 411 using four bow holder fasteners 410A, 410B, 410C, 410D. The upper bow holder 410 is releasably attached to the lower bow holder 411 so that the upwardly facing channel of the lower bow holder and the downwardly facing channel of the upper bow holder form a cavity. The cavity allows a stabilizer of an archery bow to fit inside. This cavity can alternatively be referred to as a bow holder cavity.

In a preferred embodiment, upper and lower bow holder pads are used. The purpose of the upper bow holder pad 415 and lower bow holder pad 416 are to provide a more secure fit. As the upper bow holder 410 and lower bow holder 411 are drawn toward each other by tightening the bow holder fasteners, the pads are compressed and expand around the periphery of a bow stabilizer thereby providing a more secure fit.

In one embodiment, the bow holder pads are not used. This is not a preferred embodiment because the fit is not a secure. However this embodiment can still be effectively used.

The components of an apparatus for calibrating an archery bow sight may be made of any material having sufficient strength to maintain the structure while supporting the weight of the archery bow and ancillary equipment. Such materials include but are not limited to metal, plastic, aluminum, and wood. Aluminum is used in a preferred embodiment because it has the advantages of being light weight with respect to other metals, yet having comparable strength to other metals.

What is claimed is:

1. An apparatus for calibrating an archery bow comprising:

a support member having a first and a second end, and being substantially elongate;

a first base support leg having a first and a second end, said first end being attached to said second end of said support member;

a second base support leg having a first and a second end, said first end being attached to said second end of said support member;

a third base support leg having a first and a second end, said first end being attached to said second end of said support member;

a bow holder housing having a first end, a middle portion, and a second end, and being substantially elongate;

means for attaching said bow holder housing to said first end of said support member;

a bow holder cavity comprising, a lower bow holder, said lower bow holder forming an upwardly facing channel, an upper bow holder, said upper bow holder forming a downwardly facing channel, said upper bow holder being releasably attached to said lower bow holder, said upwardly facing channel of said lower bow holder and said downwardly facing channel of said upper bow holder forming a cavity and being capable of receiving the stabilizer of an archery bow;

means for attaching said bow holder cavity to said first end of said bow holder housing;

whereby the stabilizer of an archery bow may be inserted into said bow holder cavity.

2. The apparatus of claim 1 further comprising:

a first leg extension having a first and a second end, said first end being slidingly attached to said second end of said first base support leg;

a second leg extension having a first and a second end, said first end being slidingly attached to said second end of said second base support leg;

a third leg extension having a first and a second end, said first end being slidingly attached to said second end of said third base support leg.

3. The apparatus of claim 1 further comprising:

said means for attaching said bow holder housing to said first end of said support member comprising a support member extension having a first and a second end, and being substantially elongate, said first end of said support member extension being attached to said bow holder housing, said second end of said support member extension being slidingly attached to said first end of said support member.

4. The apparatus of claim 1 further comprising:

said means for attaching said bow holder cavity to said first end of said bow holder housing comprising a bow holder housing extension having first and second ends, said first end of said bow holder housing extension being attached to said bow holder cavity, said second end of said bow holder housing extension being slidingly attached to said first end of said bow holder housing.

5. An apparatus for calibrating an archery bow comprising:

a base member;

a first support leg male coupling attached to said base member;

a second support leg male coupling attached to said base member;

a third support leg male coupling attached to said base member, whereby said first, second, and third support leg male couplings are attached to said base member at equidistant points around the periphery of said base member;

a first base support leg having a first and a second end, said first end being releasably attached to said first support leg male coupling;

a second base support leg having a first and a second end, said first end being releasably attached to said second support leg male coupling;

a third base support leg having a first and a second end, said first end being releasably attached to said third support leg male coupling;

a first leg extension having a first and a second end, said first end being slidingly attached to said second end of said first base support leg;

a second leg extension having a first and a second end, said first end being slidingly attached to said second end of said second base support leg;

a third leg extension having a first and a second end, said first end being slidingly attached to said second end of said third base support leg;

a support member having a first and a second end, and being substantially elongate, said second end being releasably attached to said base member;

a support member extension having a first and a second end, and being substantially elongate, said second end being slidingly attached to said first end of said support member;

a bow holder housing having a first end, a middle portion, and a second end, and being substantially elongate, said bow holder housing being hollow within, said first end being open ended, said middle portion being attached to said first end of said support member extension, said second end having a hole;

a bow holder housing extension having a first and second end, and being substantially elongate, said second end having a threaded hole and being capable of being inserted into said first end of said bow holder housing;

a bow holder tightening bolt having a threaded first end and a second end, said first end passing through said hole in said second end of said bow holder housing and releasably engaging said second end of said bow holder housing extension;

a bow holder cavity comprising:

a lower bow holder having a lower surface and an upper surface, said lower bow holder forming an upwardly facing channel, said lower surface being attached to said first end of said bow holder housing extension, a lower bow holder pad attached to said upper surface of said lower bow holder, an upper bow holder having a lower surface and an upper surface, said upper bow holder forming a downwardly facing channel, an upper bow holder pad attached to said lower surface of said upper bow holder, wherein said upper bow holder is releasably attached to said lower bow holder, said upwardly facing channel of said lower bow holder and said downwardly facing channel of said upper bow holder forming a cavity and being capable of receiving a stabilizer of an archery bow;

whereby a stabilizer of an archery bow may be inserted into said cavity.

* * * * *